United States Patent [19]

Lee

[11] Patent Number: 4,901,459

[45] Date of Patent: Feb. 20, 1990

[54] SWING DEVICE FOR DOLLS IN GROUPS

[76] Inventor: Yeong R. Lee, P. O. Box 10780, Taipei, 10099, Taiwan

[21] Appl. No.: 125,187

[22] Filed: Nov. 25, 1987

[51] Int. Cl.[4] ..... G09F 19/08

[52] U.S. Cl. ..... 40/414; 40/418; 446/353; 446/354; 446/356

[58] Field of Search ..... 40/414, 411, 415, 416–421; 446/334, 298, 359, 361, 72, 353, 354, 356, 184, 290, 320

[56] References Cited

U.S. PATENT DOCUMENTS

| | | | |
|---|---|---|---|
| 478,423 | 7/1892 | Gregg | 446/359 |
| 1,187,708 | 6/1916 | Carruthers et al. | 40/420 |
| 1,570,268 | 1/1926 | Marx | 446/298 |
| 1,731,396 | 10/1929 | Root | 446/334 |
| 1,975,287 | 10/1934 | Polatty | 40/416 |
| 2,765,583 | 10/1956 | Gamble | 40/420 |
| 2,821,801 | 2/1958 | Pruitt, Sr. | 40/420 |
| 2,932,919 | 4/1960 | Evans | 40/418 |

*Primary Examiner*—Kenneth J. Dorner

*Assistant Examiner*—J. Hakomaki

*Attorney, Agent, or Firm*—Sherman and Shalloway

[57] ABSTRACT

The present invention provides a doll which has a pair of legs and a frame, with a generally horizontal slotted follower, fixed onto the top of the legs. A movable support frame for supporting the upper torso of the doll is pivotally mounted at its upper and lower ends onto the frame. A first motor is installed on the movable support frame, and an eccentric pin member is operatively connected to and activated by the first motor for actuating the hand rod and the head rod of the dolls. The slotted follower of the frame provides a slot which slidingly receives the eccentric pin member. While the eccentric pin member is rotating around the axis of the first motor, the movable support frame is activated and turn right and left reciprocatively thereby. A plurality of corresponding or similar dolls may be pivotally mounted onto a connecting rod inside of the box; thus, the dolls will swing simultaneously while the connecting rod is activated by a second motor in the box to move reciprocatively in a transverse direction.

20 Claims, 6 Drawing Sheets

SWING DEVICE FOR DOLLS IN GROUPS

BACKGROUND OF THE INVENTION

Most of conventional Christmas decorations, especially the decorative dolls in show windows or homes such as Santa Claus, angels, bears, . . . etc., are stuffed items without any motions. Those dolls can only offer decoration by the use of gaudy clothings or special shapes, but after a period of time, the stationary monotony will gradually decrease their decorative appeal. Some manufacturers have tried to add motions to those dolls by applying drive mechanisms of speed-reducing gear box with clutches and cams, but the big noises and complicated mechanisms make them fail in popularity.

The above-mentioned conventional dolls are disclosed in U.S. Pat. Nos. 4,407,090, 3,995,394, 4,003,158 and 4,422,261, but their designs are for single decoration only, and do not offer interesting group motions. And the reciprocating motion of a single doll will generate tiresome monotony in a short time.

BRIEF SUMMARY OF THE INVENTION

One object of this invention is to improve the defects of conventional decorative dolls by offering a simple and noiseless device installed inside the dolls to make their heads/hands move in an interesting manner.

Another object of the invention is to supply a simple device which can make the dolls' upper bodies turn right and left, and their heads and hands move with decorative gestures.

A further object of this invention is to offer a device that can make several dolls swing simultaneously.

To achieve the above objects, this invention reveals a device whose embodiments will be described in detail with reference to the accompanying drawings as follows:

DETAILED DESCRIPTION OF THE PREFERRED EMBODIMENTS

Figure 2:
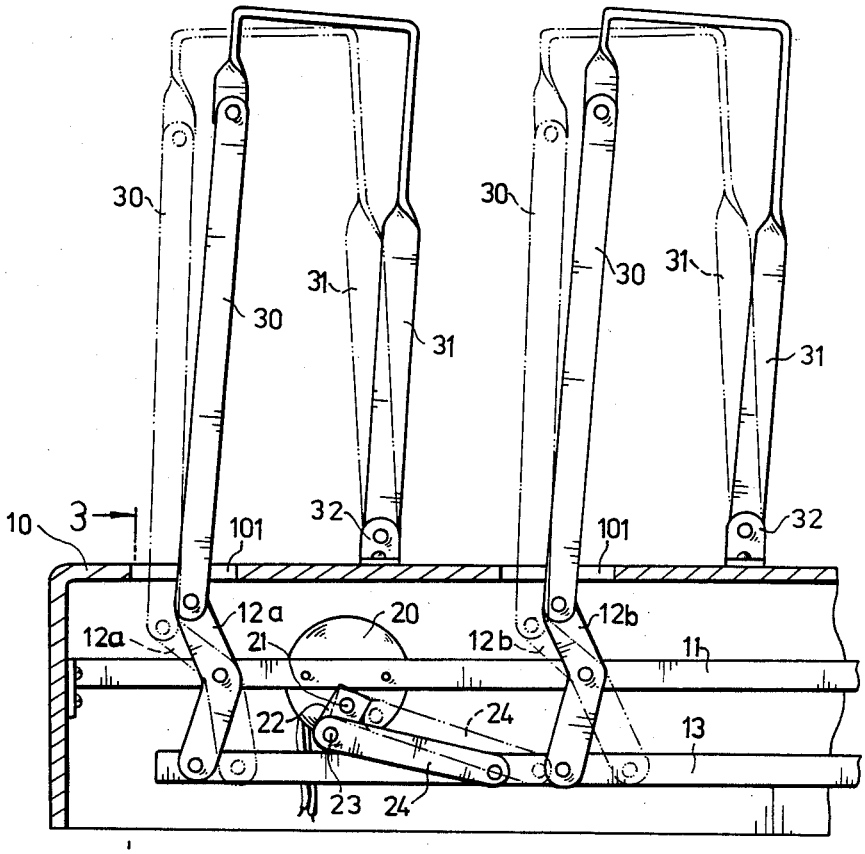
FIG. 2 is an enlarged fragmentary sectional view of the device shown in FIG. 1.
Figure 3:
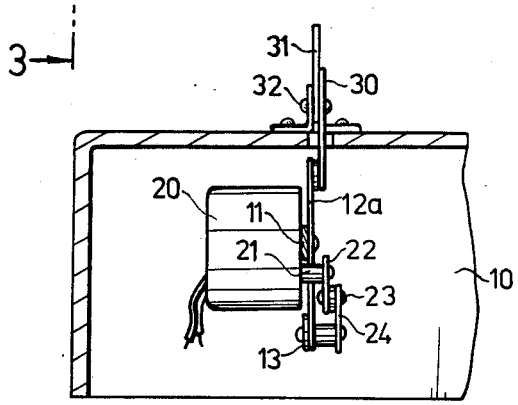
FIG. 3 is an end sectional view taken along lines 3—3 of FIG. 2.
Figure 4:
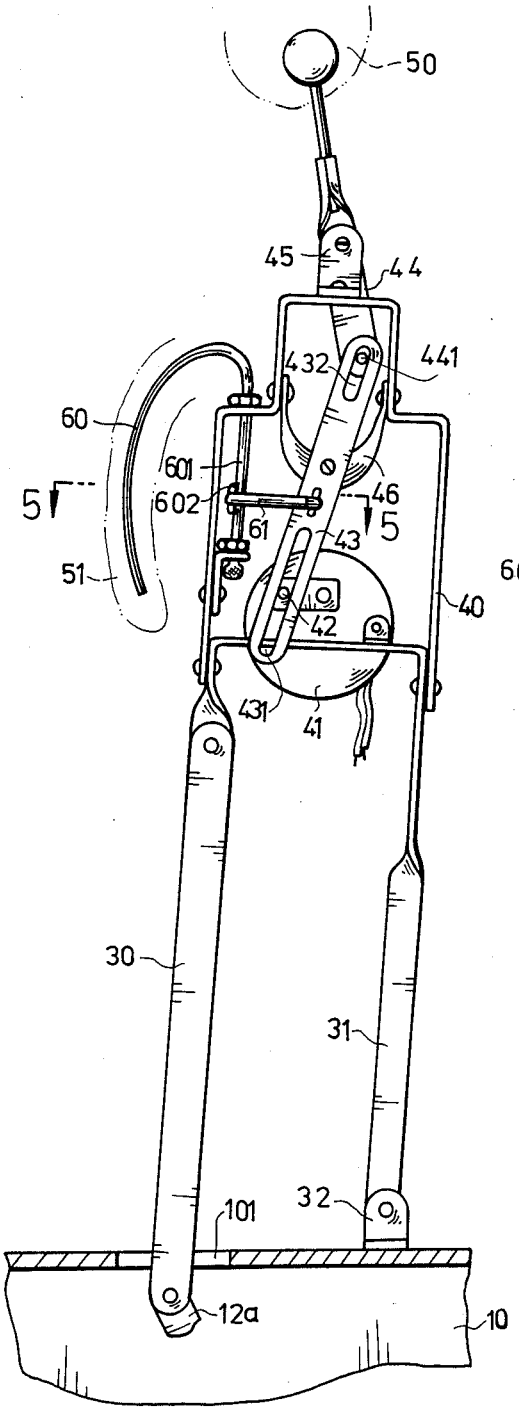
FIG. 4 is an elevational view of one embodiment of the present invention in which only the head and hand of the doll are activated.
Figure 5:
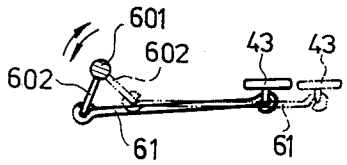
FIG. 5 is a partial action view of a short arm taken along lines 5—5 of FIG. 4.
Figure 9:
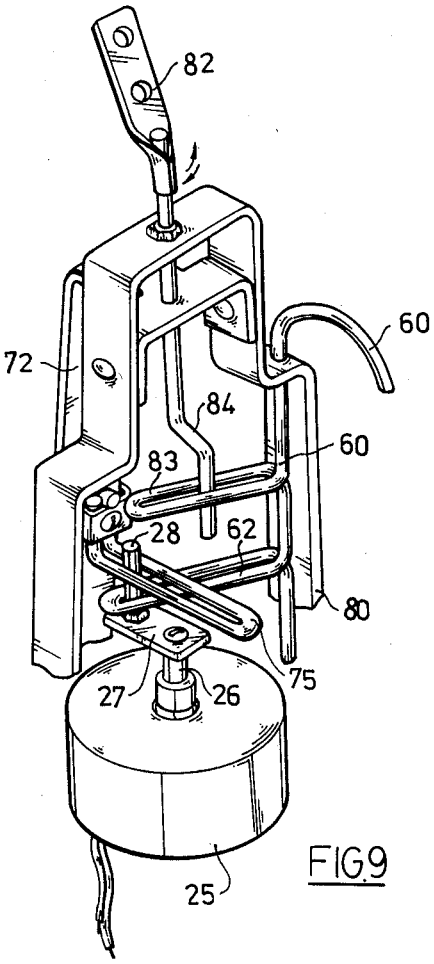
FIG. 9 is a fragmentary perspective view of a third embodiment similar to the embodiment of FIG. 6.
Figure 10:
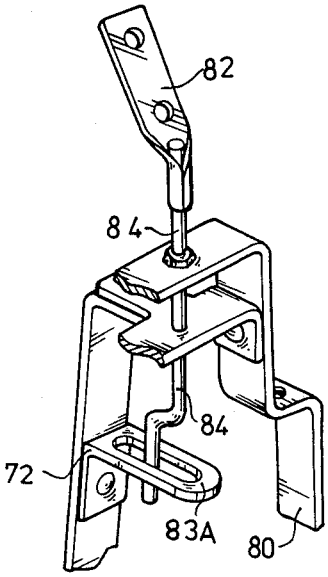
FIG. 10 is a partial perspective view of a fourth embodiment similar to the embodiment of FIG. 6.
Figure 11:
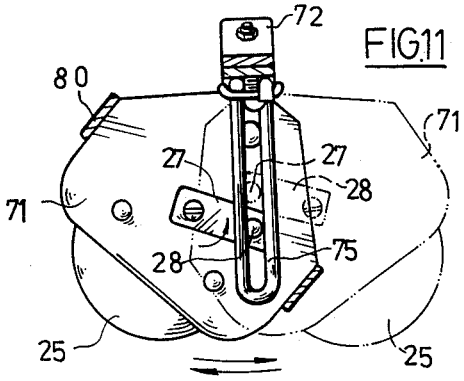
FIG. 11 is a top sectional view taken along lines 11—11 of FIG. 6.

FIGS. 6, 7, 8 and 11 set forth a preferred embodiment in which the dolls' upper torso is provided with right and left turning movement and the doll's hand is simultaneously provided with movement. FIG. 9 sets forth a further embodiment in which the doll's head is able to be turned right and left by activating a hand rod. FIG. 10 also sets forth an embodiment in which the doll's head is turnable. Furthermore, the doll of the embodiment of FIGS. 6, 7, 8 and 11 may be pivotally mounted on the drive device shown in FIGS. 1, 2 and 3 either singularly or plurally, and the dolls may be activated to have their torsos swing right and left simultaneously. Of course as shown in FIGS. 4 and 5, the dolls pivotally mounted on the device of FIGS. 1–3 may merely have head and hand movement without turning of the upper torso.

As shown in FIG. 1 to FIG. 4, a show box 10, able to be formed as an attractive stage, has several holes 101 for passing through the legs 30 of each of the dolls. And inside the box 10, there is a fixed transverse lever 11 pivotally holding several swing levers **12*a*, 12*b*, . . . etc., and a fixed motor 20**.

A rotatable shaft 21 of the motor 20 has one end fixed to a rotating link member 22 whose other end will be fixed with a pin member 23 which is generally parallel to but spaced from the axis of the motor rotatable shaft 21 so as to be eccentric. Therefore, when output shaft 21 of motor 20 gets rotating, pin 23 will rotate around output shaft 21 and also drive a link 24 in a crank motion, so as to move a long connecting rod 13 to the left or the right reciprocatively.

As the lower ends of the swing levers **12*a*, 12*b*, . . . , are pivotally installed on the connecting rod 13, the connecting rod 13 moves to the left or the right reciprocatively, and every swing lever will move accordingly. The upper ends of the swing levers 12*a*, 12*b*, . . . , are respectively pivotally connected with the leg 30 of each doll, while another leg 31 of each doll has its base pivotally installed on a bracket 32 fixed on the box 10. By attaching a first leg 30 and a second leg 31 together for each doll, with the first leg 30 being pivoted on a separate swing lever 12 and the second leg 31 being connected to the bracket 32, when the swing levers 12*a*, 12*b*, . . . etc. move together, the dolls with their fulcrums on the brackets 32** will swing together likewise, showing an orderly beauty. A further improved device for imparting different motions to each doll will further enhance the variety of decoration of the orderly beauty of the dolls. It is contemplated that the action of the dolls' heads and hands can be driven by any of the following embodiments or other appropriate methods.

An embodiment of the doll of the invention is shown in FIGS. 6, 7, 8 and 11. The doll has a pair of legs 30 and 31, the lower end of the leg 30 is pivotally mounted on the swing lever **12*a* and the lower end of the leg 31 is pivotally mounted on a bracket 32; the upper ends of the legs 30 and 31 are combined together to hold a fixed frame 72 wherein a washer 73 is put on the top of this frame 72 and is pivotally connected to the upper portion of a convex-shaped movable support frame 80 while another washer 74 is put beneath the lower end of this frame 72 and is pivotally set on the base plate 72 installed under frame 80. Washers 73 and 74** are aligned on the same axis.

The middle portion of frame 72 is fixed with a generally horizontal slotted follower 75 which will function as a slot slidingly receiving a pin member 28 which extends substantially parallel to the axle of the motor 25 and fixed to one end of a rotating link member 27 whose other end is fixed on the end of the rotatable shaft 26 of the motor 25. The pin member 28 can be also formed by curving the rotatable shaft 26 of the motor 25 directly, or by fastening a crank-shaped eccentric rod to shaft 26, so as to rotate eccentrically, spaced from the axis of the shaft 26.

A hand rod 60 has its upper and lower ends respectively pivotally mounted on the sides of the movable support frame 80, and a generally horizontal slotted follower 62 is set on the lower end of the hand rod 60 to hold the pin member 28 of the link member 27. The upper end of the hand rod 60 is pivoted and extends out of the frame 80 as a free end able to combine with the hand 51 of the doll. A head rack 82, installed upon the movable support frame 80, is to be combined with the head 50 of the doll.

Figure 6:
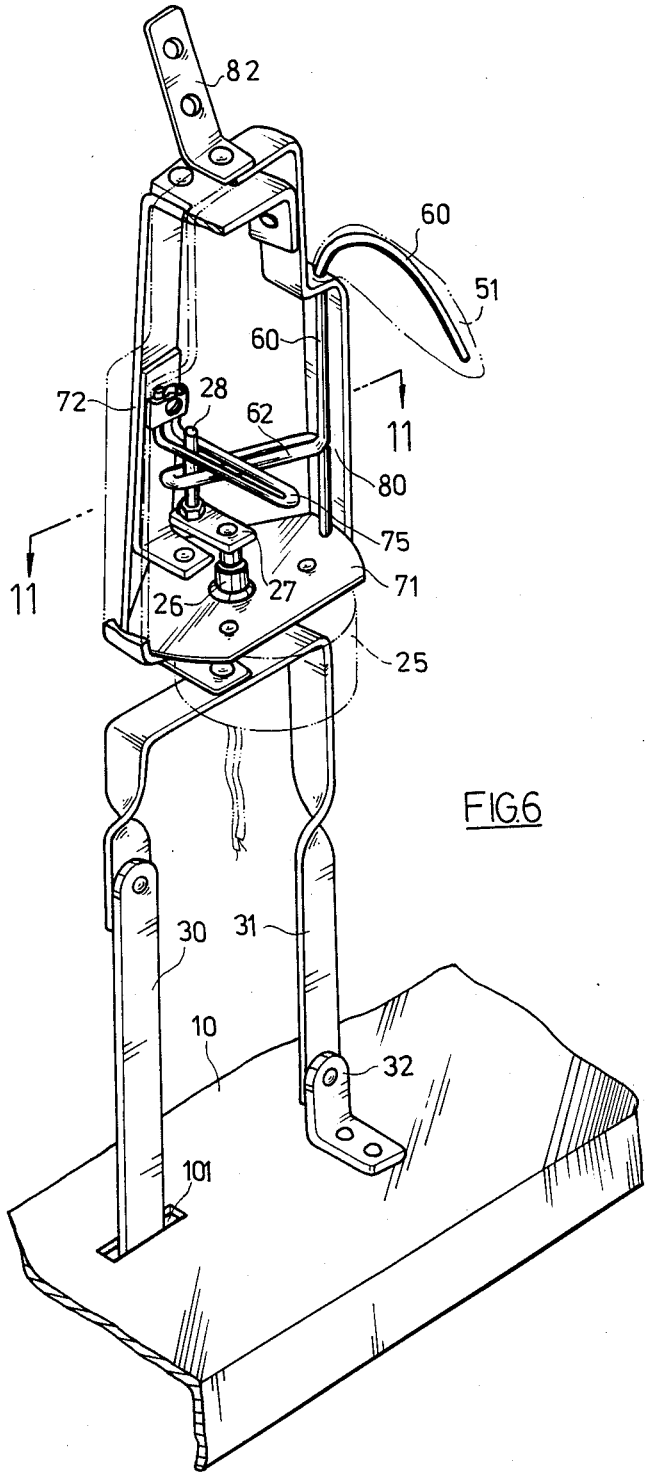
FIG. 6 is a perspective view of a second embodiment of the present invention in which the dolls upper torso can be turned to the right and left.
Figure 8:
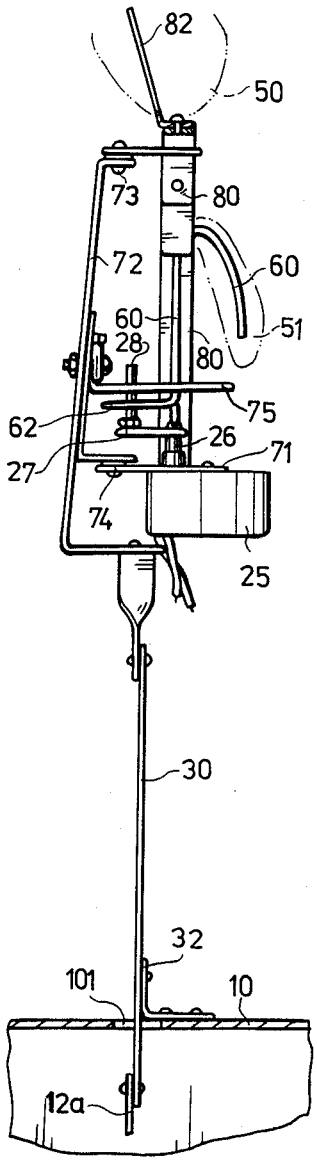
FIG. 8 is a side elevational view of the embodiment of FIG. 6.
Figure 7:
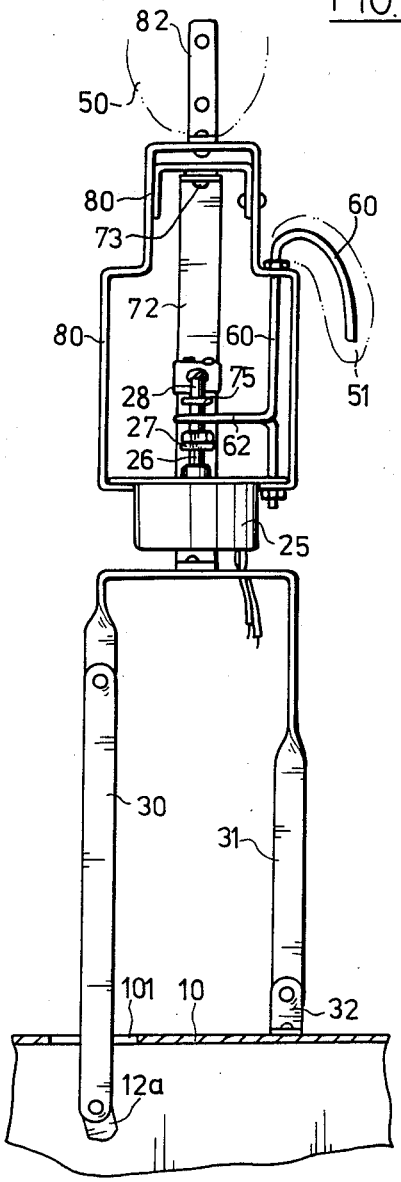
FIG. 7 is an elevational view of the embodiment of FIG. 6.

Referring to the above mentioned embodiment illustrated in FIG. 6 to FIG. 8, when motor 25 eccentrically rotates the eccentric pin 28, it would normally rotate the slotted follower 75 of the frame 72 to turn right and left around the pivotal axis of the washers 73 and 74; but since the slotted follower 75 is fixed on frame 72, the movable support frame 80 will be correspondingly driven to turn right and left by the motion of the pin 28. With the movable support frame 80 combining with the upper torso of the doll, the doll will turn its upper torso when the movable support frame 80 turns right and left; at the same time, the eccentric pin member 28 will activate the slotted follower 62 of the hand rod 60 to swing, so as to make the hand 51 of the doll to act as well. The head 50 of the doll will also act together with the frame 80.

Another embodiment is shown in FIG. 9. A second generally horizontal slotted follower 83 of the hand rod 60 is fixed on the middle portion of the rod 60, and the lower end of the crank-shaped head rod 84, whose upper end is connected with the head rack 82 mentioned above, extends into the slotted follower 83, such that the head 50 combined with the head rack 82 is activated to turn right and left while the hand rod 60 is moving. When the movable support frame 80 causes the upper body of the doll to turn right and left, the doll appears as though it is keeping watch for patrolling, when the hand 51 swings, the head 50 will be driven to turn right and left as well; this motion to imitate patrolling is so vivid as to supply a highly decorative effect.

Still another embodiment of a similar effect is for moving the upper torso of the doll to turn right and left as shown in FIG. 10. The lower end of the head rod 84 is received into a slotted follower 83A which is fixed to the frame 72, and the slotted follower 83A is located on the upper portion of the frame 72 and is parallel to the other slotted follower 75. When the movable support frame 80 turns, because of the change of the corresponding positions, head rod 84 will be driven as well by the eccentric shaft. Besides, the slotted follower 83A can be revised as a plate with a long slot; this revision in construction can also serve a similar function without fail.

Figure 1:
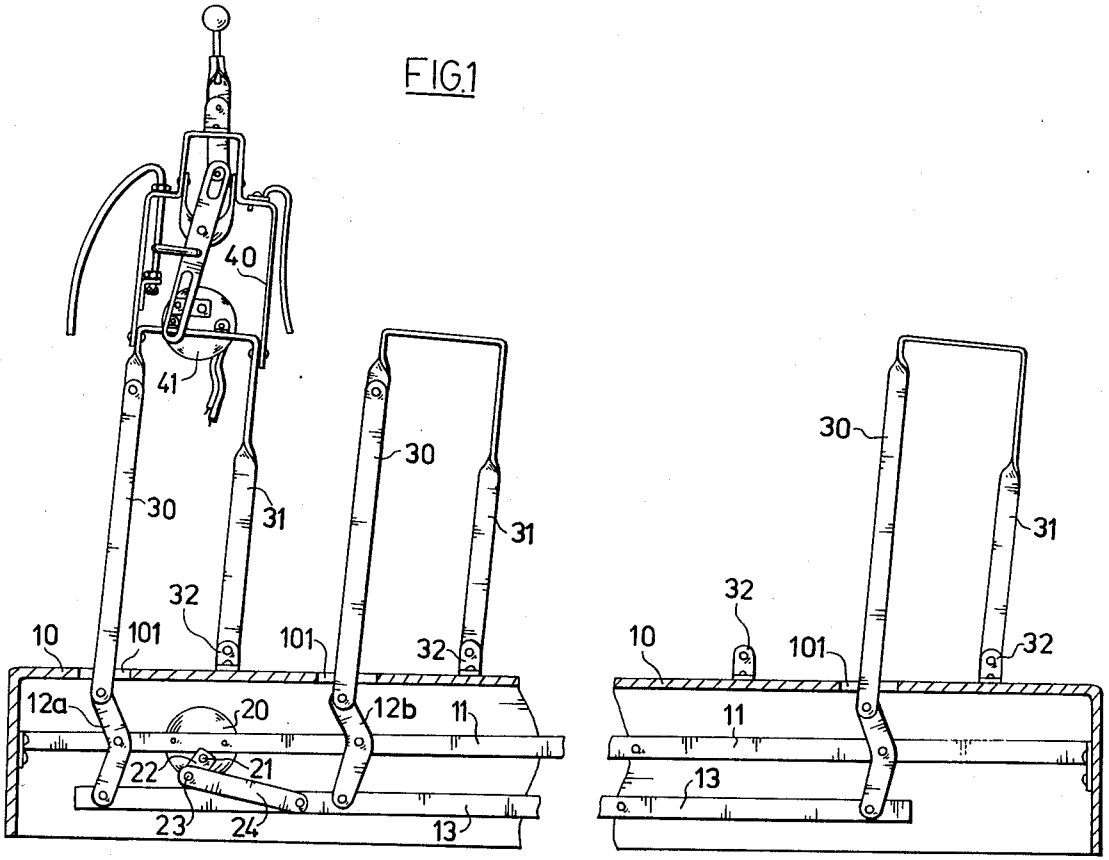
FIG. 1 is an elevational view in section of the swing device which is able to drive dolls in groups.

As shown in FIGS. 1, 4 and 5, a frame 40 is fixed over the upper end of the two legs 30 and 31 of each doll. And within the inner space of frame 40, a motor 41 is fixed transversely, and the shaft end of the motor 41, functioning the same as the rotatable shaft of motor 20 in box 10 to drive the eccentric pin member 23, is fixed with a pin member 42 able to rotate around the axle of motor 41; the pin member 42 will be put in a slot 431 of a swing rod 43 whose middle portion is pivotally installed on a supporter 46 of the frame 40. When the pin member 42 rotates around the axis of motor 41, the swing rod 43 will be driven to move to the left or the right. The other slot 432 of the swing rod 43 holds a pin 441 fixed on the lower end of the head rod 44 whose middle portion is pivotally fixed to a base 45 of the frame 40; therefore, when the swing rod 43 moves, head rod 44 is activated as well, and by connecting the doll's head 50 on the upper end of the head rod 44, the doll's head will swing to the left or the right as well.

Besides, a hand rod 60, pivotally installed on the side of the frame 40, has one end kept within the inner space of the frame 40 as a function end 601, and the other end protrudes outside of the frame 40 and is a free end which combined with the doll's hand 51; as shown in FIG. 5, function end 601 has a horizontal short arm 602 whose end is fastened to a connecting rod 61 pivotally mounted on the swing rod 43. While the swing rod 43 moves, the hand rod 60 is activated to turn reciprocatingly so as to make the doll's hand 51 on the free end of the hand rod 60 swing as well. The devices described above provide quite simple constructions for making the dolls' hands and heads move.

The above embodiments are set forth to describe the novel features of this invention but not to limit the claim scope of this invention.

I claim:

1. A drive device for providing decorative action to a doll comprising:

a first doll leg;

a second doll leg;

a main frame comprising a first frame portion and a second frame portion;

said first frame portion being mounted on and supported by said first and second legs;

a first slotted follower mounted on said first frame portion;

said second frame portion being pivotally mounted on said first frame portion for supporting an upper portion of the doll; and a first activating means, including an eccentric pin member operatively connected in a slot of said first slotted follower, mounted on said main frame for moving said second frame portion relative to said first frame portion between a first position and a second position, such that a first animated motion is imparted to said second frame portion of said doll upon activation of said first activating means.

2. A drive device as recited in claim 1, wherein said first slotted follower is mounted generally horizontally on said first frame portion, said second frame portion is pivotally mounted about a substantially vertical axis on said first frame portion, and said first activating means is mounted on second frame portion, such that said first animated motion is defined by a pivotal motion of said second frame portion about said substantially vertical axis.

3. A drive device as recited in claim 2, wherein said first activating means comprises:

a motor having a substantially vertical rotatable output shaft;

a link member having a first and a second end, said first end of said link member being fixedly connected to the output shaft of said motor for rotation therewith; and said eccentric pin member is fixed to a substantially horizontally disposed face of said second end of said link member and extends substantially parallel to said output shaft of said motor.

4. A drive device as recited in claim 3, further comprising a hand rod, having a first end and a second end, pivotally mounted on a side of said second frame portion, said first end of said hand rod being a free end and adapted to receive a doll's hand thereon, and said second end of said hand rod including an integral substantially horizontal second slotted follower with a slot operatively receiving said pin member of said first activating means, such that a second animated motion is imparted to said hand rod upon activation of said motor.

5. A drive device as recited in claim 1, wherein said first slotted follower is mounted generally vertically on said first frame portion, said second frame portion is pivotally mounted about a substantially horizontal axis on said first frame portion, and said first activating means is mounted on said first frame portion, such that said first animated motion is defined by pivotal motion of said second frame portion about said substantially horizontal axis.

6. A drive device as recited in claim 5, wherein said first activating means comprises:

a motor having a substantially horizontal rotatable output shaft;

a link member having a first end and a second end, said first end of said link member being fixedly connected to the output shaft of said motor for rotation therewith; and said eccentric pin member is fixed to a substantially vertical face of said second end of said link member and extends substantially parallel to said output shaft of said motor.

7. A drive device as recited in claim 6, wherein said second frame portion comprises a head rod, having a first end and a second end, pivotally mounted to said first frame portion about a substantially horizontal axis, said first end of said head rod being a free end and adapted to receive a doll's head thereon, said second end of said head rod having a pin attached thereto which extends substantially horizontally therefrom and operatively connects in a second slot of said first slotted follower, such that rotation of said output shaft of said motor causes corresponding to-and-fro movements of said head rod.

8. A drive device as recited in claim 6, further comprising a hand rod, having a first end and a second end, pivotally mounted about a substantially vertical axis on a side of said first frame portion said first end of said hand rod being a free end and adpated to receive a doll's hand thereon, and means for operatively connecting said second end of said hand rod to said first slotted follower, such that rotation of said output shaft of said motor causes corresponding movement of said hand rod.

9. A drive device as recited in claim 8, wherein said connecting means comprises a horizontal short arm having a first end and a second end, said first end of said short arm being fixed to said second end of said hand rod and extending radially outwardly therefrom;

a link bar having a first end and a second end, said first end of said link bar being pivotally connected with said second end of said short arm and said second end of said link bar being pivotally connected to said first slotted follower.

10. A drive device as recited in claim 7, further comprising a hand rod, having a first end and a second end, pivotally mounted about a substantially vertical axis on a side of said first frame portion, said first end of said hand rod being a free end and adapted to receive a doll's hand thereon, and means for operatively connecting said second end of said hand rod to said first slotted follower, such that rotation of said output shaft of said motor causes corresponding movement of said hand rod.

11. A drive device as recited in claim 1, further comprising:

a box;

a leg bracket fixed to an upper surface of said box and pivotally attached to said first doll leg;

a swing lever, having a first end and a second end, pivotally mounted within said box, said first end of said swing lever being pivotally attached to said second doll leg;

a connecting rod having a first end and a second end, said first end of said connecting rod being pivotally attached to said second end of said swing lever;

a second activating means, installed in said box, for reciprocatively driving said connecting rod, such that a decorative action is imparted to said first and second doll legs relative to said box.

12. A drive device as recited in claim 3, further comprising:

a box;

a leg bracket fixed to an upper surface of said box and pivotally attached to said first doll leg;

a swing lever, having a first end and a second end, pivotally mounted within said box, said first end of said swing lever being pivotally attached to said second doll leg;

a connecting rod having a first end and a second end, said first end of said connecting rod being pivotally attached to said second end of said swing lever;

a second activating means, installed in said box, for reciprocatively driving said connecting rod, such that a decorative action is imparted to said first and second doll legs relative to said box.

13. A drive device as recited in claim 4, further comprising:

a box;

a leg bracket fixed to an upper surface of said box and pivotally attached to said first doll leg;

a swing lever, having a first end and a second end, pivotally mounted within said box, said first end of said swing lever being pivotally attached to said second doll leg;

a connecting rod having a first end and a second end, said first end of said connecting rod being pivotally attached to said second end of said swing lever;

a second activating means, installed in said box, for reciprocatively driving said connecting rod, such that a decorative action is imparted to said first and second doll legs relative to said box.

14. A drive device as recited in claim 6, further comprising:

a box;

a leg bracket fixed to an upper surface of said box and pivotally attached to said first doll leg;

a swing lever, having a first end and a second end, pivotally mounted within said box, said first end of said swing lever being pivotally attached to said second doll leg;

a connecting rod having a first end and a second end, said first end of said connecting rod being pivotally attached to said second end of said swing lever;

a second activating means, installed in said box, for reciprocatively driving said connecting rod, such that a decorative action is imparted to said first and second doll legs relative to said box.

15. A drive device as recited in claim 7, further comprising:

a box;

a leg bracket fixed to an upper surface of said box and pivotally attached to said first doll leg;

a swing lever, having a first end and a second end, pivotally mounted within said box, said first end of said swing lever being pivotally attached to said second doll leg;

A connecting rod having a first end and a second end, said first end of said connecting rod being pivotally attached to said second end of said swing lever;

a second activating means, installed in said box, for reciprocatively driving said connecting rod, such that a decorative action is imparted to said first and second doll legs relative to said box.

16. A drive device as recited in claim 8, further comprising:

a box;

a leg bracket fixed to an upper surface of said box and pivotally attached to said first doll leg;

a swing lever, having a first end and a second end, pivotally mounted within said box, said first end of said swing lever being pivotally attached to said second doll leg;

a connecting rod having a first end and a second end, said first end of said connecting rod being pivotally attached to said second end of said swing lever;

a second activating means, installed in said box, for reciprocatively driving said connecting rod, such that a decorative action is imparted to said first and second doll legs relative to said box.

17. A drive device for providing decorative action to a doll, comprising:

a box;

a plurality of dolls, each having a first leg and a second leg, a first frame portion mounted on said first and second legs, a second frame portion pivotally attached to said first frame portion, and an activating means for causing pivotal motion of said second frame portion relative to said first frame portion, such that a first animated motion is imparted to said second frame portion of said doll upon activation of said first activating means; and a drive means mounted to said box for causing movement of each of said first and second legs of each of said plurality of dolls, simultaneously; said movement of each of said first and second legs being relative to the other of said first and second legs and to said box, such that each of said plurality of dolls is moved in unison.

18. A drive device as recited in claim 17, further comprising a plurality of leg brackets fixed to said box;

each of said first legs of each of said plurality of dolls being pivotally attached to one of said plurality of leg brackets.

19. A drive device as recited in claim 18, wherein:

said activating means comprises a first motor mounted on said second frame portion and including a rotatable, substantially vertical output shaft, and a pin eccentrically mounted to said output shaft; and said first frame portion includes a substantially horizontal slotted follower fixedly mounted thereon, said pin being operatively mounted in said slotted follower, such that a first animated motion is imparted to said second frame portion upon activation of said first motor.

20. A drive device as recited in claim 19, wherein said drive means comprises:

a second motor with a rotatable output shaft;

a plurality of swing levers, each having a first end and a second end, pivotally mounted in said box about a plurality of pivots, said first end of each of said plurality of swing levers being pivotally connected with said second leg of each of said plurality of dolls; and motion converting means, connected between said output shaft of said second motor and said second end of each of said plurality of swing levers, for converting rotary motion of said output shaft of said motor to to-and-fro motion of said plurality of swing levers about said plurality of pivots, such that a decorative action is imparted to each of said second doll legs in unison upon activation of said second motor.

* * * * *